US007004051B1

(12) United States Patent
Orner

(10) Patent No.: US 7,004,051 B1
(45) Date of Patent: Feb. 28, 2006

(54) PANIC BAR RELEASE TOOL KIT

(76) Inventor: Benjamin Orner, 15226 Daphne Ave., Gardena, CA (US) 90249

( * ) Notice: Subject to any disclaimer, the term of this patent is extended or adjusted under 35 U.S.C. 154(b) by 11 days.

(21) Appl. No.: 11/113,717

(22) Filed: Apr. 26, 2005

(51) Int. Cl.
*B25B 33/00* (2006.01)

(52) U.S. Cl. ..... 81/15.9; 81/177.1

(58) Field of Classification Search ..... 81/488, 81/15.9, 177.1, 177.8, 3.4, 64; 206/576
See application file for complete search history.

(56) References Cited

U.S. PATENT DOCUMENTS 4,348,835 A * 9/1982 Jones et al. ..... 49/139
4,836,061 A * 6/1989 Weinraub ..... 81/15.9
4,876,927 A 10/1989 Mullen
5,123,307 A 6/1992 Dyer
5,642,648 A * 7/1997 Wendt et al. ..... 81/15.9
6,360,637 B1 3/2002 Weinraub

* cited by examiner

*Primary Examiner*—Jacob K. Ackun, Jr.
(74) *Attorney, Agent, or Firm*—Mark Ashley Crossley; Crossley Patent Law

(57) ABSTRACT

A kit and method for use in opening a locked door with panic bar, the kit comprising a rigid generally J-shaped rod, a circular grab ring in one end of the rod, a generally straight extension on an opposite, bottom end of the J, a drill bit and hole plugs, whereby a door is drilled, the rod inserted, the door unlocked, and the holes filled with plugs.

11 Claims, 4 Drawing Sheets

PANIC BAR RELEASE TOOL KIT

BACKGROUND OF THE INVENTION

Many buildings install and use doors with typical panic bar latch mechanisms. The mechanisms are equipped with a panic bar installed to face inwardly. The panic bar is a means of emergency release of the latch mechanism for those exiting the door. It is not uncommon to have to enter a latched mechanism from the exterior. This is typically a locksmith job. The job typically requires destructive measures on entry. In some cases, a glass panel of the door is broken out in order to access the panic bar positioned on the door face within. In still other cases, door locks and the like are drilled out or otherwise destroyed. These destructive and invasive maneuvers are not the best nor the least expensive methods of gaining access through a locked door. The current invention solves these problems with a means of gaining access without undue destruction of a door. The present invention also offers repair of the access after the door is unlatched.

FIELD OF THE INVENTION

The invention relates to unlatching doors fitted with panic bar latch mechanisms and more specifically to a panic bar release tool kit and method of use.

SUMMARY OF THE INVENTION

The general purpose of the panic bar release tool kit, described subsequently in greater detail, is to provide a panic bar release tool kit which has many novel features that result in an improved panic bar release tool kit which is not anticipated, rendered obvious, suggested, or even implied by prior art, either alone or in combination thereof.

The invention is comprised of a J-shaped rod. The rod is rigid. The rod is made of spring steel. Further examples use various alloys. All are rigid. The top of the J-shape is comprised of a grab ring. The grab ring is about 1 inch in diameter. The rod progresses into a gradual bend. A generally straight extension projects from the gradual bend. The gradual bend further comprises a midpoint of the bend. The midpoint is about 9 inches from the bottom of the grab ring. The end of the extension of the rod is about 4 inches from the midpoint. The rod is thereby easily inserted into a hole that is drilled through a typical metal door in order to gain access to the panic bar release therein. The rod is offered in various other sizes to address atypical door widths. One example of the rod is rubber coated so that a door is not marred with use of the rod. The rod diameter is 3/16 inch. Other examples vary in thickness such that various width doors and panic bars can be more easily addressed.

The kit further comprises a drill bit. The bit is hardened for access through metal doors. The bit is sized slightly larger than the J-shaped rod. The bit to match the 3/16 inch rod is % inch in diameter.

The kit further comprises hole plugs. The plugs are used to fill the access holes drilled in the door. Hole plugs are offered in various diameters to fit the above disclosed variations in the kit offerings. One exemplary plug comprises a relatively smooth outer plug face. The opposite side of the plug is fixed with a plurality of expansion ears for insertion into the hole drilled, after the rod is used to release a panic bar. The plugs are known in the mechanical arts.

The kit offers an inexpensive, non-destructive solution to gaining access to locked doors. The kit is inexpensively produced and sold. The kit can be used by virtually anyone with basic mechanical skills.

Thus has been broadly outlined the more important features of the panic bar release tool kit so that the detailed description thereof that follows may be better understood and in order that the present contribution to the art may be better appreciated.

Numerous objects, features and advantages of the panic bar release tool kit will be readily apparent to those of ordinary skill in the art upon reading the following detailed description of presently preferred, but nonetheless illustrative, examples of the panic bar release tool kit when taken in conjunction with the accompanying drawings.

In this respect, before explaining the current examples of the panic bar release tool kit in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the panic bar release tool kit. It is therefore important that the claims be regarded as including such equivalent constructions insofar as they do not depart from the spirit and scope of the present invention.

Objects of the panic bar release tool kit, along with various novel features that characterize the invention are particularly pointed out in the claims forming a part of this disclosure. For better understanding of the panic bar release tool kit, its operating advantages and specific objects attained by its uses, refer to the accompanying drawings and description.

DETAILED DESCRIPTION OF THE DRAWINGS

With reference now to the drawings, and in particular FIGS. 1 through 5 thereof, example of the panic bar release tool employing the principles and concepts of the present invention and generally designated by the reference number 10 will be described.

Figure 1:
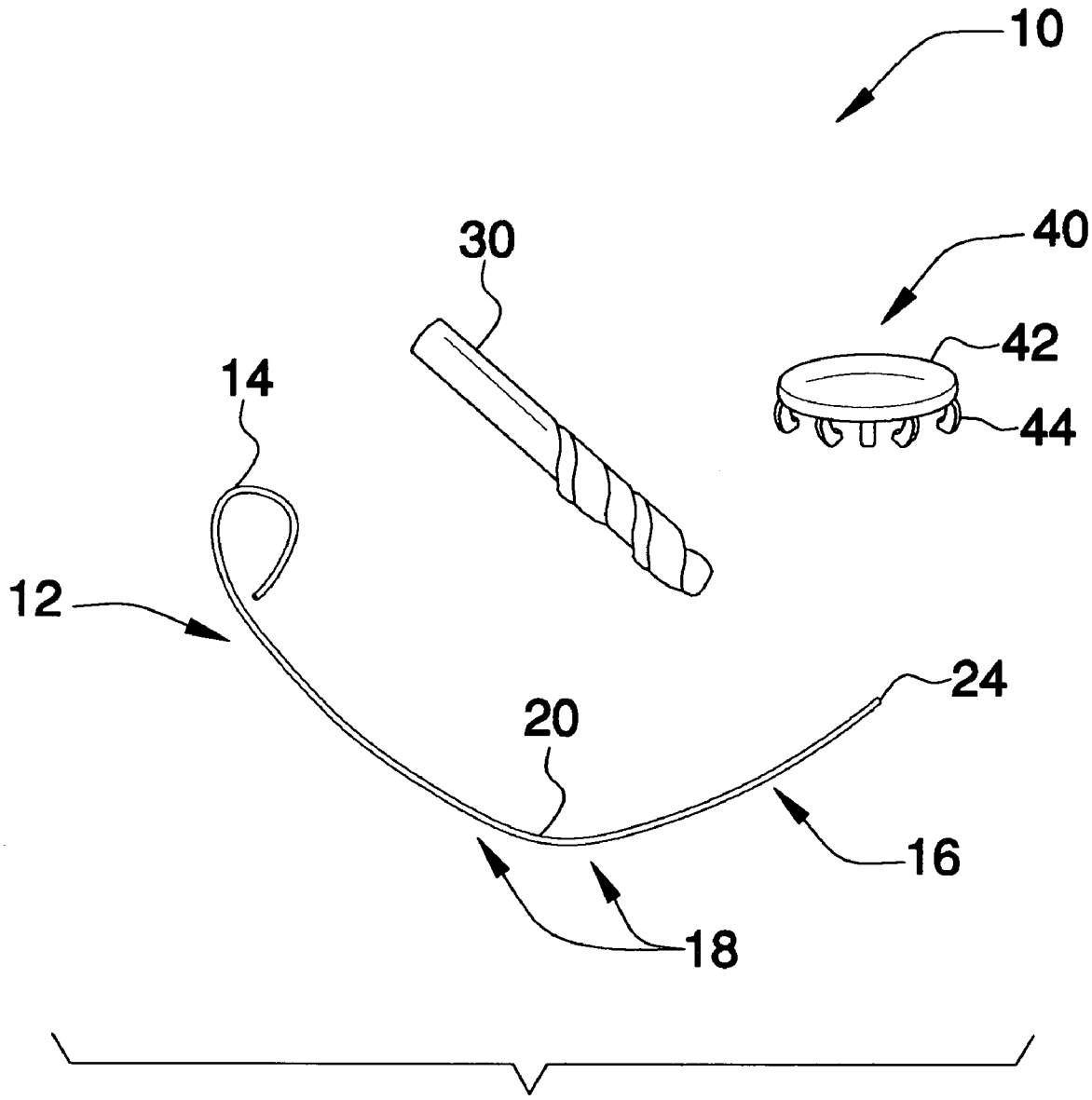
FIG. 1 is a perspective view of the rod, drill bit, and hole plug of the invention.

Referring to FIG. 1, the kit 10 used in opening a locked door 70 with panic bar 96 comprises a generally J-shaped rod 12. The rod 12 is rigid. The rod 12 is comprised of a circular grab ring 14 on one end. The grab ring 14 designates a top of the J-shaped rod 12. The rod 12 is further comprised of a gradual bend 18. The bend 18 is coplanar to the grab ring 14. The midpoint 20 locates an approximate center of the gradual bend 18. A generally straight extension 16 extends from the midpoint 20. The extension 16 ends in the opposite end 24 of the J-shaped rod 12. The distance from the midpoint 20 to a bottom of the grab ring is about 9 inches. The distance from the midpoint 20 to the end 24 of the rod 12 is about 4 inches. The grab ring 14 is about 1 inch in diameter. The rod is about 3/16 inch in diameter. The kit 10 is further comprised of a typical drill bit 30. Drill bit 30 is hardened for penetration through steel doors. The drill bit 30 is about ¼ inch in diameter. The kit 10 is further comprised of a hole plug 40. The hole plug 40 is comprised of a plug face 42. The lower side of the plug 40 is comprised of a plurality of expansion ears 44.

Figure 2:
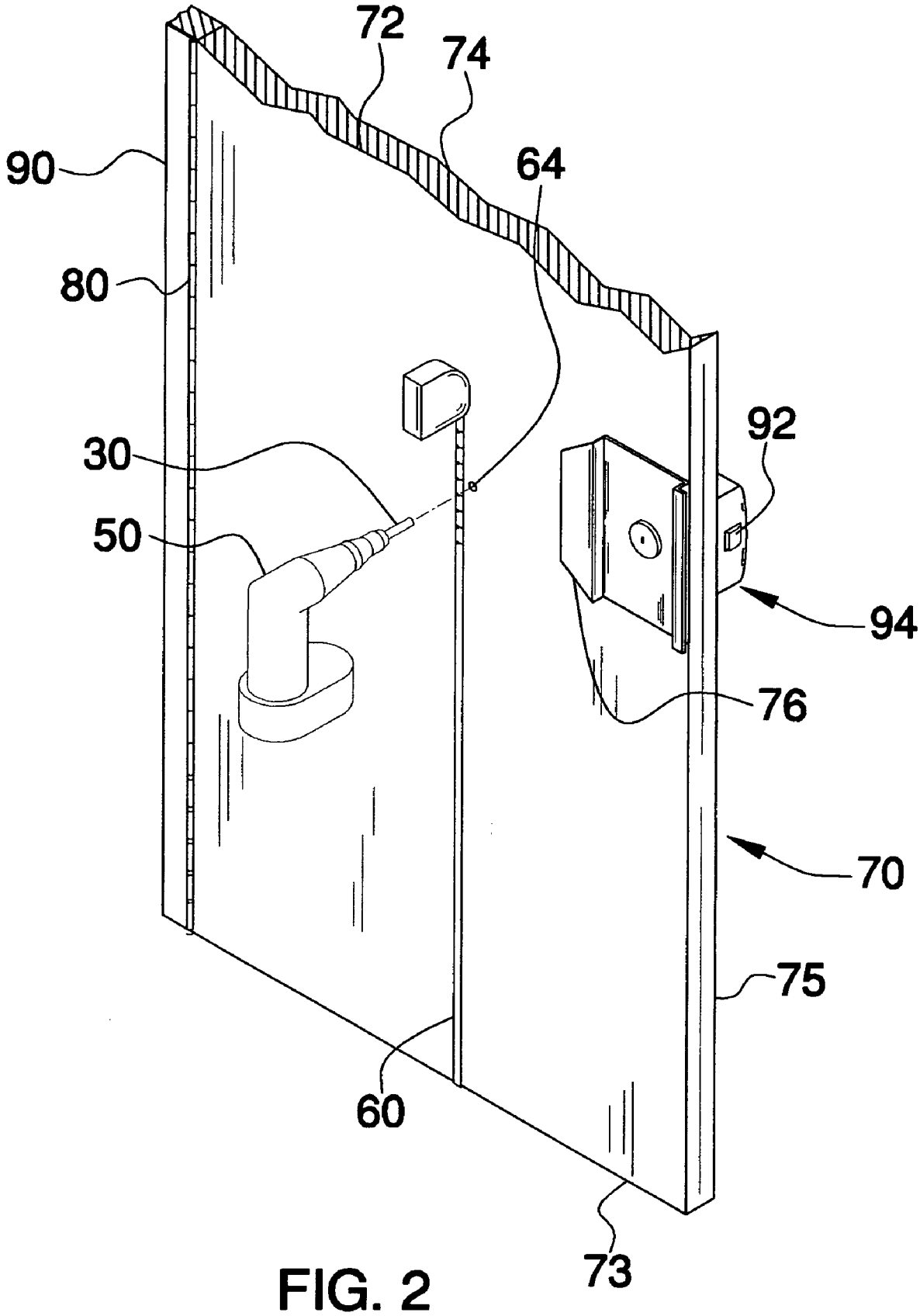
FIG. 2 is a perspective view of a typical locked door to be released by the invention, a measuring tape and a typical drill in use.

Referring to FIG. 2, a typical steel door 70 is hung from a typical door jamb 90. the door swings about a typical hinge 80. The door is further comprised of a an outer face 72, a thickness, and an inner face 74. The typical lock mechanism 94 further comprises a typical latch 92. The handle 76 is disposed on the outer face 72. The measuring tape 60 locates the hole 64 drilled through the door 70. The hole is about 38 inches from the door bottom 73. The hole is about 16 inches from the door edge 75. The drill 50 is chucked with the drill bit 30.

Figure 3:
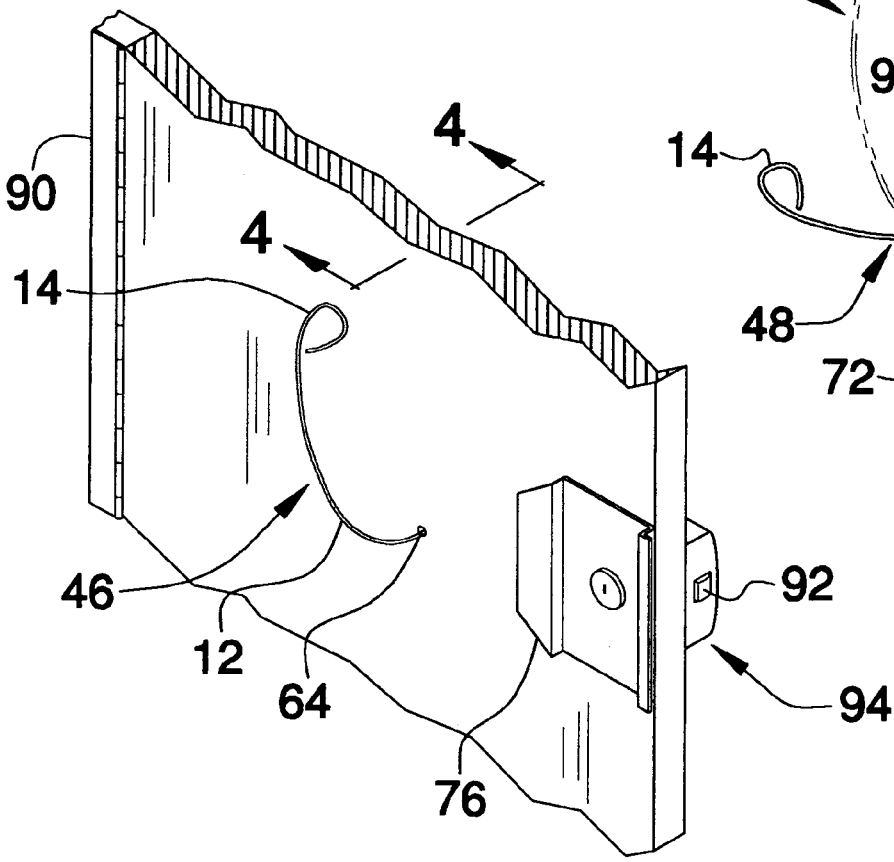
FIG. 3 is a perspective view of the rod of the invention being inserted into the hole drilled in a typical door.

Referring to FIG. 3, the rod 12 has begun entry into the hole 64. The rod 12 is in the insertion position 46. The grab ring 14 is located well above the hole 64 in the outer face 72 of the door 70. The latch mechanism 94 is partially comprised of the latch 92. the handle 76 is disposed on the outer face 72 of the door 70.

Figure 4B:
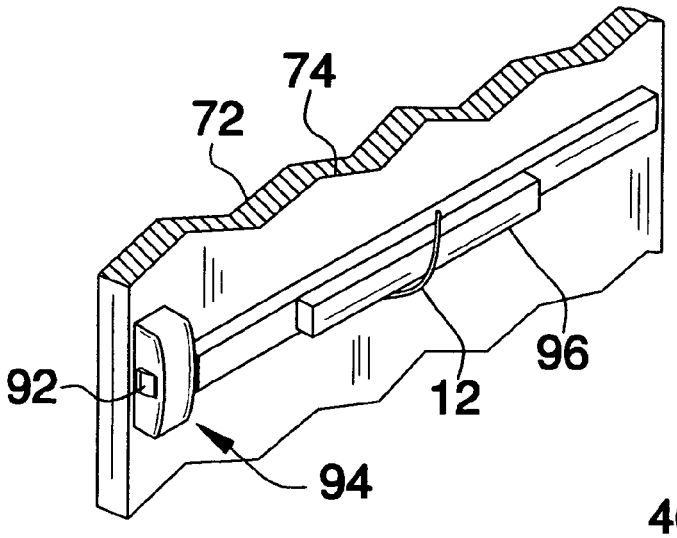
FIG. 4*b* is an interior perspective view of FIG. 3 taken along the line 4—4, the panic bar engaged by the rod of the invention.
Figure 4:
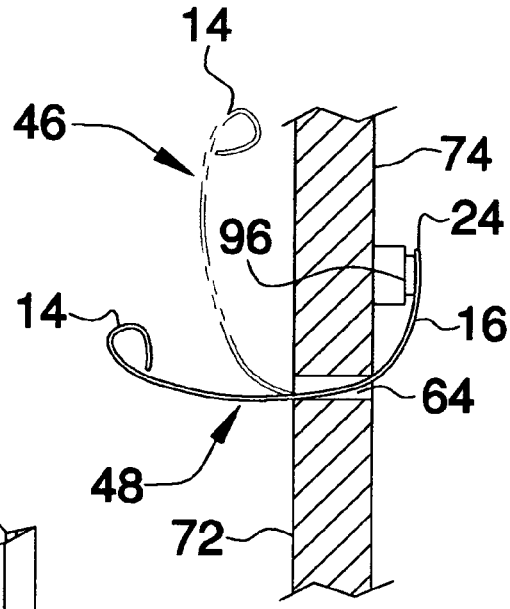
FIG. 4 is a side elevation view of FIG. 3 taken along the line 4—4, the rod of the invention inserted through the door and engaging the panic bar of the door.

Referring to FIG. 4, the insertion position 46 of the rod 12 positions grab ring 14 well above the hole 64. The use position 48 of the rod 12 positions the grab ring 14 approximately equal to the height of the hole 64. The extension 16 of the rod 12 is now against the panic bar 96.

Referring to FIG. 4*b*, the inner face 74 of the door 70 is fitted with the latch mechanism 94. The panic bar 96 is a typical part of the latch mechanism 94. The extension of the rod 12 has engaged the panic bar 96. Pressure from the extension 12 against the panic bar 96 causes release of the latch 92.

Figure 5B:
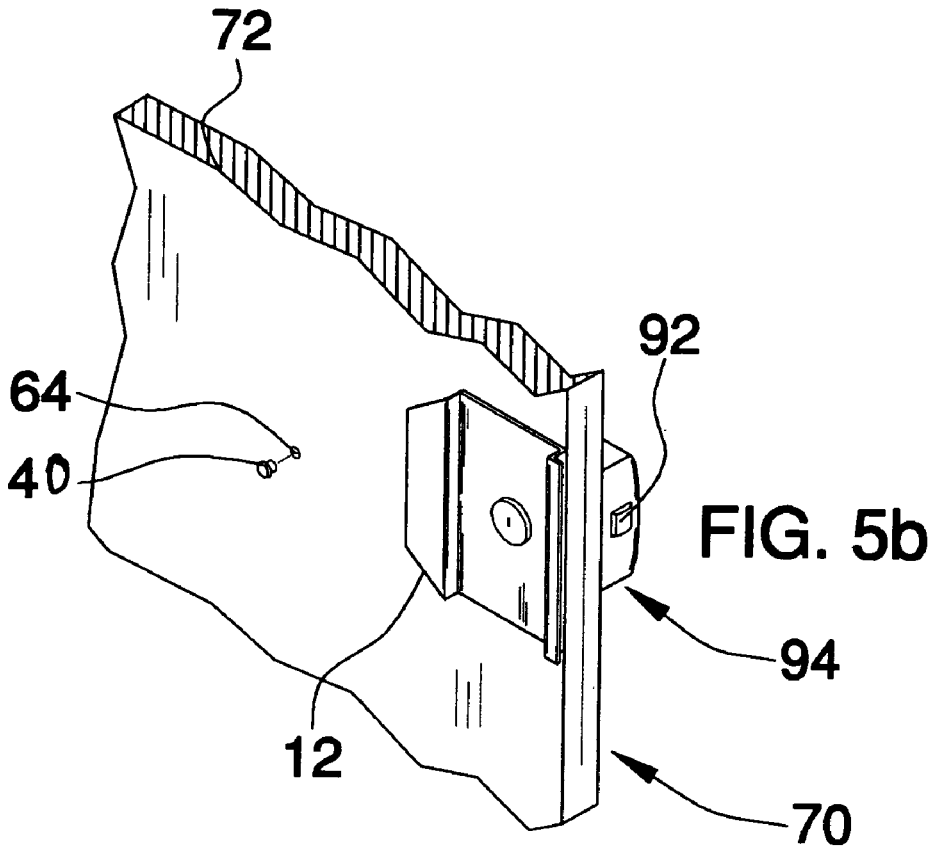
FIG. 5*b* perspectively illustrates the hole plug in preparation of installation into the hole.
Figure 5:
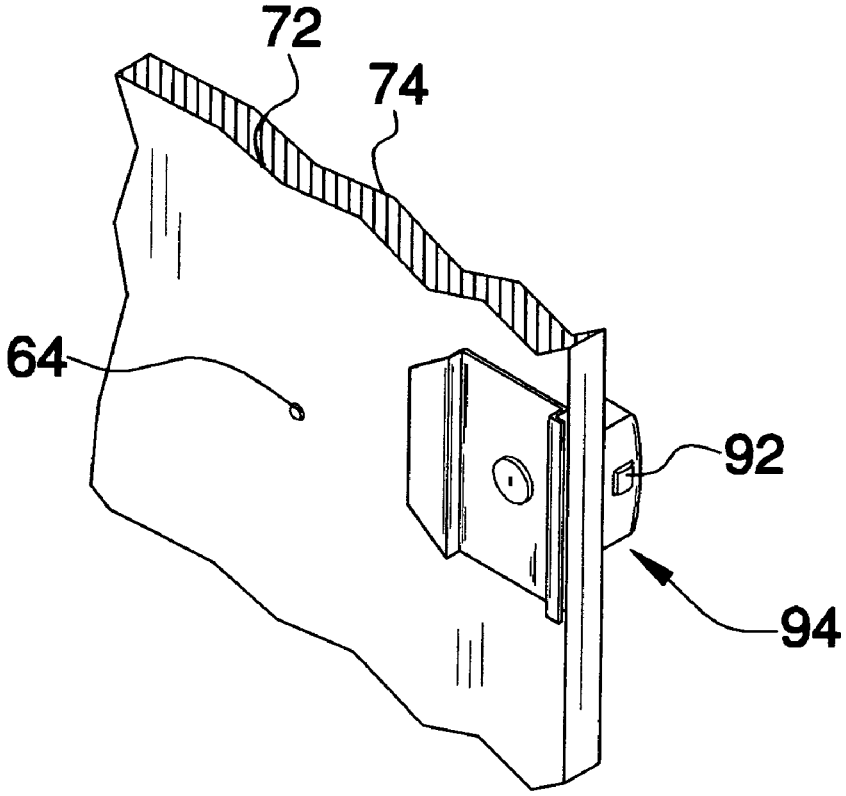
FIG. 5 is a perspective view of the hole drilled in the outer face of the door.

Referring to FIG. 5, the hole 64 in the outer face 72 of the door 70 awaits the insertion of the hole plug 40.

Referring to FIG. 5*b* the hole plug 40 is prepared for insertion into the hole 64. A second hole plug 64 (not shown) is inserted into the hole 64 in the inner face 74 of the door 70.

To use the kit 10, the locked steel door 70 with a latch mechanism 94 with panic bar 96 is located. A drill 50 is acquired. The drill bit 30 is chucked into the drill 50. The door 70 is measured from the door bottom 73 to a point about 38 inches up. A second measurement is taken from the door edge 75 about 16 inches in. The juncture of the two measurements is marked. A hole 64 is drilled completely through the door 70. The rod 12 is acquired.

The rod end 24 is inserted through the hole 64. The rod 12 is turned such that the grab ring 14 is vertically positioned above the hole 64. The grab ring 14 is pulled such the extension 16 is forced against the panic bar 96 such that the latch 92 is released. The door 70 is held open. The rod 12 is removed. The hole plugs 40 are acquired. The hole plug 40 is positioned such that the expansion ears 44 face the hole 64 in the outer face 72 of the door 70. The plug face 42 faces outwardly. The expansion ears 44 are forced into the hole. The process is repeated on the inner door face 74.

With respect to the above description then, it is to be realized that the optimum dimensional relationships for the parts of the panic bar release tool kit, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A kit for use in opening a locked door with panic bar, the kit comprising:

a rigid generally J-shaped rod, the rod about 3/16 inch in diameter;

a circular grab ring in one end of the rod, the grab ring designating a top of the J;

a gradual bend of the J;

a midpoint of the gradual bend, the midpoint about 9 inches from a bottom of the grab ring;

a generally straight extension on an opposite, bottom end of the J;

an end of the straight extension, the end about 4 inches from the midpoint of the gradual bend;

a ¼ inch drill bit;

two ¼ inch hole plugs.

2. The invention in claim 1 wherein the gradual bend of the J and the extension are rubber coated.

3. The invention in claim 1 wherein the entire rod is rubber coated.

4. The invention in claim 2 wherein each hole plug is further comprised of expansion ears.

5. The invention in claim 3 wherein each hole plug is further comprised of expansion ears.

6. The invention in claim 4 wherein the grab ring is about 1 inch in diameter.

7. The invention in claim 5 wherein the grab ring is about 1 inch in diameter.

8. A method of use of a kit for opening a locked door with a panic bar, the kit comprising a rigid generally J-shaped rod;

a circular grab ring in one end of the rod, the grab ring designating a top of the J;

a gradual bend of the J;

a midpoint of the gradual bend, the midpoint about 9 inches from a bottom of the grab ring;

a generally straight extension on an opposite, bottom end of the J;

an end of the straight extension, the end about 4 inches from the midpoint of the gradual bend;

a drill bit, the bit of a diameter larger than a diameter of the rod;

two hole plugs, the plugs sized to match a hole drilled by the bit, the method comprising the acts of:

locating a locked steel door with panic bar;

acquiring a drill;

chucking the drill bit into the drill;

measuring the locked door, a first measurement about 38 inches up from a bottom of the door;

measuring a second measurement about 16 inches in from a striker side of the door;

marking a juncture of the two measurements;

drilling a horizontal hole completely through the door at the marked juncture;

acquiring the rod;

inserting the rod end through the hole;

turning the rod such that the grab ring is in a vertical position above the hole;

pulling the grab ring such that the extension is forced against the panic bar of the locked door, such that a latch of the door is released;

holding the door open;

removing the rod;

acquiring the plugs;

inserting the plugs into door holes on both sides of the door.

9. The method of use of the invention in claim 8 wherein the rod is rubber coated.

10. The method of use of the invention in claim 9 wherein the grab ring is about 1 inch in diameter.

11. A method of use for a kit used in opening a locked door with panic bar, the kit comprising:

a rigid generally J-shaped rod, the rod about 3/16 inch in diameter;

a circular grab ring in one end of the rod, the grab ring designating a top of the J;

a gradual bend of the J;

a midpoint of the gradual bend, the midpoint about 9 inches from a bottom of the grab ring;

a generally straight extension on an opposite, bottom end of the J;

an end of the straight extension, the end about 4 inches from the midpoint of the gradual bend;

a 1/4 inch drill bit;

two 1/4 inch hole plugs;

a face on each plug;

a plurality of expansion ears on a side of each plug opposite the plug face;

the method comprising the steps of:

locating the locked door with panic bar;

acquiring a drill;

chucking the drill bit into the drill;

measuring the locked door, a first measurement about 38 inches up from a bottom of the door;

measuring a second measurement about 16 inches in from a striker side of the door;

marking a juncture of the two measurements;

drilling a horizontal hole completely through the door at the marked juncture;

acquiring the rod;

inserting the rod end through the hole;

turning the rod such that the grab ring is in a vertical position above the hole;

pulling the grab ring such that the extension is forced against the panic bar of the locked door whereby a latch of the door is released;

holding the door open;

removing the rod;

acquiring the plugs;

positioning the expansion ears of one plug toward the hole in one side of the door;

inserting the plug into hole;

positioning the expansion ears of the other plug toward the hole in other side of the door;

inserting the plug into the hole.

* * * * *